US008302586B2

(12) United States Patent
Isabelle

(10) Patent No.: US 8,302,586 B2
(45) Date of Patent: Nov. 6, 2012

(54) PAINTBALL MARKER LOADING AND FEEDING SYSTEM

(76) Inventor: Michael Allan Isabelle, Vancouver (CA)

( * ) Notice: Subject to any disclaimer, the term of this patent is extended or adjusted under 35 U.S.C. 154(b) by 287 days.

(21) Appl. No.: 12/726,213

(22) Filed: Mar. 17, 2010

(65) Prior Publication Data

US 2011/0226226 A1 Sep. 22, 2011

(51) Int. Cl.
*F41B 11/02* (2006.01)

(52) U.S. Cl. ..... 124/49

(58) Field of Classification Search ..... 124/45, 124/49, 50, 51.1

See application file for complete search history.

(56) References Cited

U.S. PATENT DOCUMENTS

| | | | | |
|---|---|---|---|---|
| 5,722,383 | A | 3/1998 | Tippmann, Sr. et al. | |
| 5,809,983 | A | 9/1998 | Stoneking | |
| 5,816,232 | A | 10/1998 | Bell | |
| 6,109,252 | A | 8/2000 | Stevens | |
| 6,273,079 | B1 * | 8/2001 | Jzn | 124/49 |
| 6,722,355 | B1 * | 4/2004 | Andrews, Jr. | 124/49 |
| 6,923,170 | B2 | 8/2005 | Ho et al. | |
| 6,935,324 | B2 | 8/2005 | Watson et al. | |
| 7,000,603 | B1 * | 2/2006 | Steenbeke | 124/45 |
| 7,216,641 | B2 * | 5/2007 | Friesen et al. | 124/45 |
| 7,270,120 | B2 | 9/2007 | Broersma et al. | |
| 7,322,348 | B2 | 1/2008 | Chen | |
| 7,426,927 | B1 | 9/2008 | Broersma | |
| 7,617,817 | B1 | 11/2009 | Kulp | |
| 7,975,681 | B2 * | 7/2011 | Handel | 124/49 |
| 2006/0180134 | A1 | 8/2006 | Illuzzi | |
| 2008/0047535 | A1 | 2/2008 | Handel | |
| 2008/0053422 | A1 | 3/2008 | Estrate | |
| 2009/0229589 | A1 | 9/2009 | Karnis | |

* cited by examiner

*Primary Examiner* — John Ricci
(74) *Attorney, Agent, or Firm* — Smiths IP

(57) ABSTRACT

An assembly for rapid loading and feeding of paintballs in a paintball marker comprises a receiver mountable on the marker, having an opening to receive and secure a magazine carrying paintballs, and a gate opening mechanism to open the magazine, releasing the paintballs. An ejection mechanism to clear a magazine from the opening may also be provided. The magazine comprises a resiliently biased gate mechanism to protect the paintballs until the magazine is inserted into the receiver. The magazine may be opened to refill it with paintballs, and may be disassembled for cleaning or maintenance.

24 Claims, 16 Drawing Sheets

94
96
81
96
96
96

94
96
81
77
F
96
96
96
77
F 70
74
76
72
78
88
72
74
76
74
72
72
74

90
92
90
92
90
92
84

88
84

86
82

PAINTBALL MARKER LOADING AND FEEDING SYSTEM

TECHNICAL FIELD OF THE INVENTION

This invention relates to a storage container and an assembly for rapid loading and feeding of ammunition into paintball markers.

BACKGROUND OF THE INVENTION

Paintball is a popular competitive game in which players attempt to eliminate other players by hitting them with projectiles filled with paint. The game therefore requires players to move and react very quickly, both to hit other players and to avoid being hit. In order to successfully hit another player, who is usually a fast-moving target, it is advantageous to be able to shoot several projectiles in rapid succession. It is therefore advantageous to have a virtually unlimited supply of paintballs to avoid running out of ammunition during a game.

Paintballs are typically stored in a hopper mounted on the paintball marker, as in the configuration shown in FIG. 1. The disadvantage of this type of hopper is that it has limited capacity. While it is possible to use a larger hopper to increase the number of paintballs available, the size of the hopper can adversely affect the balance and ease of use of the marker, and will provide a larger target for other players to hit.

It is known to provide hoppers mounted in various positions on, or incorporated directly into, various parts of a marker. For example, U.S. Pat. No. 6,935,324 to Watson describes a hopper having multiple chambers that is designed to fit over essentially the entire top surface of the marker, creating the appearance of a rifle. Other examples of hopper embodiments are provided in U.S. Pat. No. 7,426,927 to Broersma, U.S. Pat. No. 6,923,170 to Ho, U.S. Pat. No. 6,109,252 to Stevens, U.S. Pat. No. 7,322,348 to Chen, U.S. Pat. No. 7,617,817 to Kulp and U.S. Publication No. 2006/0180134 to Illuzzi.

U.S. Patent Publication No. 2008/0053422 to Estrate describes several high capacity reloading magazines, all springing off of a standard egg-shaped hopper. However Estrate's various configurations are even higher-profile than a regular hopper, and therefore present a larger target for opposing players. Further, the magazines are long, bulky and add significant weight to the marker, making it more difficult for the player to move quickly and stealthily.

A second disadvantage of the typical hopper, and of many of the other hopper assemblies referred to above, is that they are generally permanently affixed to the marker, meaning that the only way to reload paintballs once the hopper is empty is to flip open a cap and pour paintballs into the hopper. The steps involved in this operation include removing a paintball storage container from the player's vest or pod harness, opening it opening the cap on the hopper, pouring paintballs from the storage container into the hopper, closing the hopper cap, closing the storage container lid, and re-stowing the storage container back in the player's vest or harness. While each individual step may take only a few seconds, the cumulative time required to accomplish the operation can mean another player has time to target the player reloading his marker, and can be the difference between winning and losing the paintball game. Further, it requires dexterity to pour paintballs from the storage container to the hopper, particularly when the player has been running around the paintball field and likely has a high level of adrenaline in his system. Paintballs are therefore often wasted when they are dropped on the ground during reloading.

There do exist paintball loading mechanisms designed to assist players with reloading their hoppers during game play. U.S. Pat. No. 5,809,983 to Stoneking discloses a paintball storage pod for insertion into a hopper opening, allowing the paintballs to flow directly into the hopper and thus eliminating the problem of pouring (and possibly spilling) paintballs into the opening in the hopper. U.S. Publication No. 2009/0229589 to Karnis discloses a similar system. These designs are intended strictly for refilling the hopper, which leaves a player essentially defenseless while waiting for the paintballs to flow from the storage pod to the hopper.

It is known to use a replaceable hopper magazine rather than a typical refillable hopper, thus minimizing downtime associated with replenishing the marker's paintball supply. U.S. Patent Publication No. 2008/0047535 to Handel discloses a two-piece arrangement comprising a base piece mounted on a marker, which feeds balls into the marker firing chamber, and an upper body pod, which interlocks with the base piece and provides paintballs to the base piece. One drawback to the Handel system is that the hopper pod has an irregular oblong shape that may not be easily portable in a typical player's vest or pod harness, as vests and harnesses typically includes holsters meant to contain uniform elongated, generally cylindrical, objects. Further, it uses a flat two-guide rail mechanism that may not be simple and secure enough for a player in the heat of battle to quickly and confidently lock the pod onto the base piece, leaving the player at the risk of losing a pod during a game. Finally, the system does not include a practical means to reload and reuse an empty pod, for example between paintball games. It is economically preferable for a player or event organizer to be able to collect emptied paintball pods, in order to refill and reuse them. It is also preferable to be able to access the inner areas of a pod, in order to remove debris that may have entered the pod or paint from a paintball that has burst inside the pod, or to fix any internal pieces that require repair.

U.S. Pat. No. 7,270,120 to Broersma et al. also discloses a marker-mounted feeder interlocked with a replaceable magazine. However, this system may not be sufficiently secure, as the magazine simply slides across the top of the marker, relying on a friction-based attachment mechanism to secure the magazine. Further, both the attachment mechanism on the marker and the magazine itself are relatively bulky and heavy-looking. A moving hood appears to be intended to protect the magazine and feed mechanism from adverse game conditions, adding another moving part to the assembly. A more secure means of attaching the magazine and of protecting the magazine/marker connection mechanism without adding bulk or additional moving parts is therefore preferable. Further, Broersma does not appear to contemplate means to refill or repair the magazine.

It is therefore an object of the present invention to provide a paintball loading and feeding assembly that overcomes the foregoing disadvantages.

It is a further object of the present invention to provide a system in which a paintball magazine can be quickly ejected once it is empty, and easily, quickly and securely replaced with a full magazine.

It is a further object of the present invention to provide a receiver for a paintball marker that will accept a full paintball magazine and efficiently hold and funnel the paintballs contained in the magazine to the marker.

It is a further object of the present invention to provide a receiver for a paintball marker that provide a realistic "firearm" feel when loading maker with a full paintball magazine.

It is a further object of the present invention to provide a replacement paintball magazine assembly for a paintball marker that can be modified to provide different paintball capacities and feeding configurations to meet the varying needs of different paintball players.

It is a further object of the present invention to provide a replacement paintball magazine for a rapid paintball marker loading and feeding system that can be easily accessed for refilling with the magazine with paintballs.

It is yet a further object of the present invention to provide a replacement paintball magazine for a rapid paintball marker loading and feeding system that can be easily assembled and disassembled for maintaining and cleaning the magazine.

These and other objects of the invention will be better understood by reference to the detailed description of the preferred embodiment which follows. Note that not all of the listed objects are necessarily met by each of the embodiments of the invention described below or by the invention as defined by each of the claims.

SUMMARY OF THE INVENTION

The invention provides a modular assembly comprising a receiver to be mounted on a paintball marker, and a magazine which is adapted to be mounted in the receiver to feed paintballs to the marker via the receiver. The magazine is designed to be securely fitted quickly and easily within the receiver, allowing for rapid loading of paintballs to the marker.

The magazine securely holds an allotment of paintballs, such that the paintballs cannot escape the magazine until it is either inserted into the receiver, opened up for refilling, or disassembled, such as for cleaning or maintenance. A gate mechanism ensures that the magazine opening through which paintballs generally pass into the receiver stays closed until a corresponding mechanism on the receiver opens the gate. Removable closure means provide access the inner sections of the magazine, allowing a user to refill, clean or otherwise maintain the magazine.

The magazine is easily accommodated in conventional vests and pod harnesses, allowing players to carry several replacement magazines during a paintball game.

In one aspect, the invention comprises a magazine for storing and feeding paintballs to a paintball marker, the magazine comprising a paintball container adapted to hold paintballs, the container comprising at least one aperture located near a first end of the container; a gate, resiliently biased to cover the aperture; and closure means to at least partially cover the first end and a second end of the container.

In another one of its aspects, the invention comprises a magazine for storing and feeding paintballs to a paintball marker. The magazine comprises an inner shell, a gate and an outer shell. The inner shell is adapted to hold paintballs, and comprises at least one aperture located near a first end of the inner shell. The gate is resiliently biased to cover the aperture in the inner shell. The outer shell is sized to encircle the inner shell and comprises at least one aperture corresponding to the aperture in the inner shell. The magazine also comprises closure means, to at least partially cover the ends of the shells in a nested arrangement. The closure means may be covered or partially closed by a sealing cap or sealing plug. The apertures may be of several configurations, including two apertures at one end, two apertures at opposite ends of the magazine, or any other suitable configuration.

In a further aspect, the magazine may comprise at least one guide rod carrying at least one spring to bias the gate to cover the aperture in the inner shell, and the gate may comprise at least one opening to accommodate the at least one guide rod. The magazine may also comprise at least one ramp within the inner shell, the ramp sloping towards the aperture of the inner shell.

In yet a further aspect, the outer shell of the magazine may comprise guide means to guide the magazine into the receiver, which may be at least one guide slot or at least one guide track adapted to interact with a receiver to guide the magazine into the receiver. The guide slot may allow a projection from the gate to interact with the receiver, thereby opening the gate. The outer shell of the magazine may also comprise a slot adapted to interact with a lock mechanism in the receiver to secure the magazine in the receiver.

In another aspect, the invention comprises a receiver to load a paintball marker with paintballs from a magazine, the receiver comprising an opening in communication with a feed neck, the opening being adapted to receive and enclose a first end of the magazine; at least one guide means within the opening to guide insertion of the magazine into the opening; and gate opening means to open the magazine, allowing paintballs to move towards the feed neck. The guide means may comprise guide slots or tracks. The receiver may further comprise a support flange extending from a lower portion of the opening. A hopper area to hold paintballs between the magazine and the feed neck may be provided, as may a paintball feed assist mechanism to move the paintballs towards the feed neck and to break up any paintball jams. Lock means to hold a magazine in place may also be provided.

In a further aspect, the gate opening means may comprise one or more protrusions on the guide means, one or more pins within the opening, or cocking means on the receiver to manually pull the magazine open.

In yet a further aspect, paintball feed to the receiver may be assisted by providing an internal ramp. A tilted receiver, such that a central longitudinal axis of the opening is not perpendicular to a central longitudinal axis of the feed neck, may also be provided, in addition to or instead of the ramp.

In another aspect, the invention comprises a loading and feeding assembly for a paintball marker comprising a magazine adapted to hold paintballs and a receiver mountable on the marker. The magazine comprises a gate biased to close an aperture in the magazine, and at least one magazine guide means; while the receiver comprises an opening adapted to enclose a front end of the magazine; receiver guide means within the opening corresponding to the guide means on the magazine; and gate opening means within the opening to open the magazine by moving the gate away from the aperture. The assembly may further comprise locking means to secure the magazine in the opening.

In a further aspect, the gate opening means may comprise one or more shoulders, being adapted to interact with the magazine guide means to move the gate away from the aperture, or may comprises at least one pin within the opening adapted to push the gate away from the aperture, or may comprise a cocking handle to manually pull the gate away from the aperture.

In yet a further aspect, the magazine guide means may comprises at least one guide slot and the receiver guide means comprises at least one guide track corresponding to the at least one guide slot. The system may also be reversed, such that the magazine guide means comprises at least one guide track and the receiver guide means comprises at least one guide slot corresponding to the at least one guide track.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENT OF THE INVENTION

Figure 1:
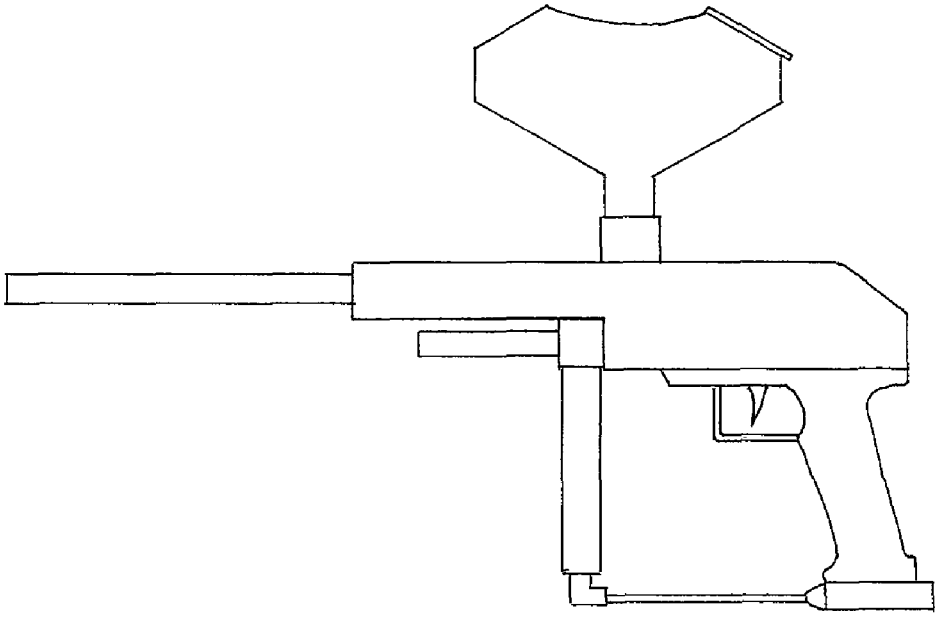
PRIOR ART FIG. 1
FIG. 1 is a side view of a conventional paintball marker, including a typical conventional hopper.
Figure 2:
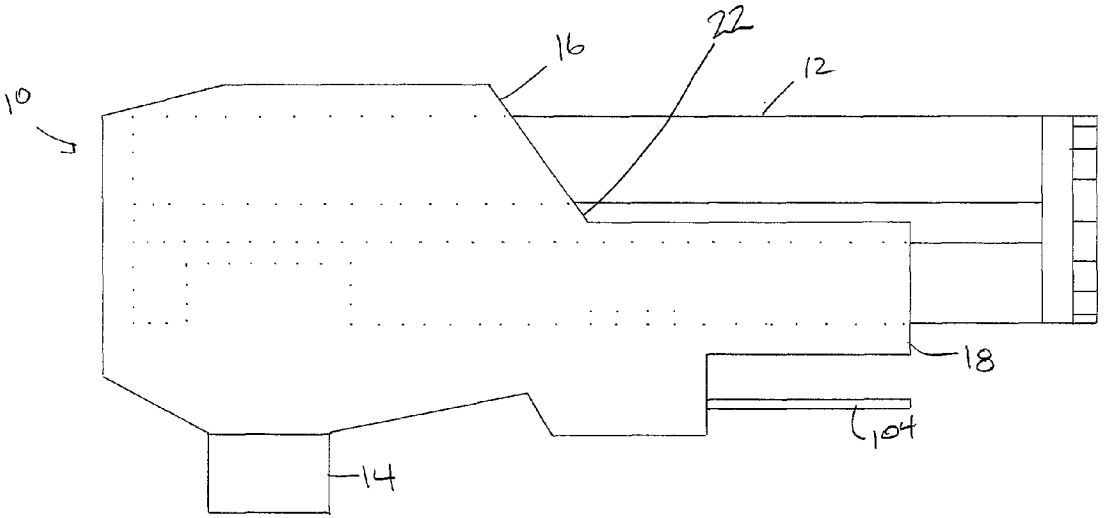
FIGS. 2 and 2A are side views of embodiments of the loading and feeding assembly of the present invention.

Referring generally to FIG. 2, the preferred embodiment of the loading and feeding assembly of the invention comprises a receiver 10 adapted to engage a magazine 12, which is adapted to hold paintballs to be fed to a marker (not shown) on which receiver 10 is mounted. Magazine 12 will be described more fully below, in relation to embodiments shown in FIG. 7 and in subsequent figures.

Receiver 10 includes a feed neck 14 through which paintballs received from magazine 12 are passed to the marker. Feed neck 14 may be of any suitable configuration such that its exterior may be securely mounted on the marker. The means by which the receiver is mounted may be any suitable means, such as clamping, friction fit, pressure fit, or any other means suited to or dictated by the particular marker and does not form part of the present invention. Receiver 10 may be sized to also serve a hopper function, for example by providing enlarged area 28, which may be of any suitable size to hold one or more paintballs between the magazine and the marker, ready to provide a paintball to the marker on demand. This may expedite loading paintballs into the marker, as the user does not have to wait for all paintballs in the current magazine to be fed through to the marker before replacing the magazine. Paintballs may move towards the marker by any suitable means, including under gravity feed or with the assistance of a mechanical, pneumatic or electric feeding means associated with the marker. A mechanical, pneumatic or electric feeding assist means 19, such as an agitator, paddle, auger or other means to move the paintballs and clear any jammed paintballs, may be provided within receiver 10.

Figure 4:
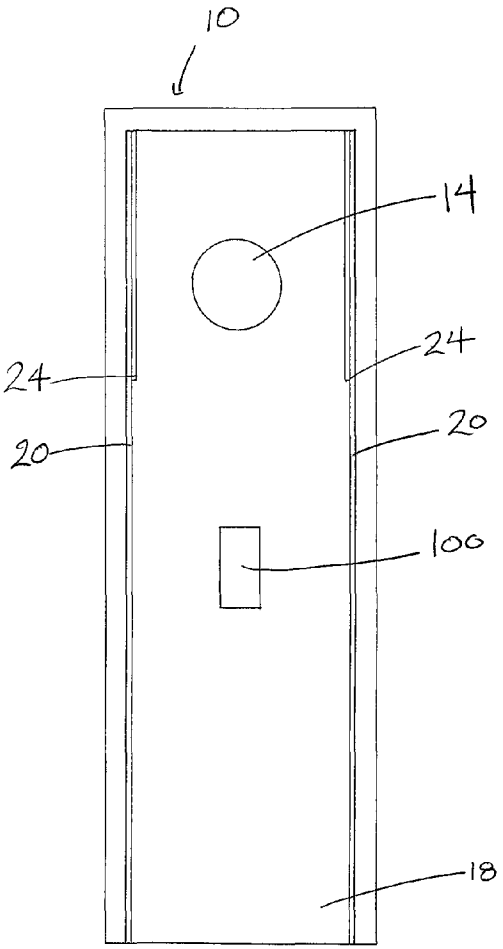
FIG. 4 is a sectional view of the embodiment of FIG. 3, taken along line A-A.
Figure 3:
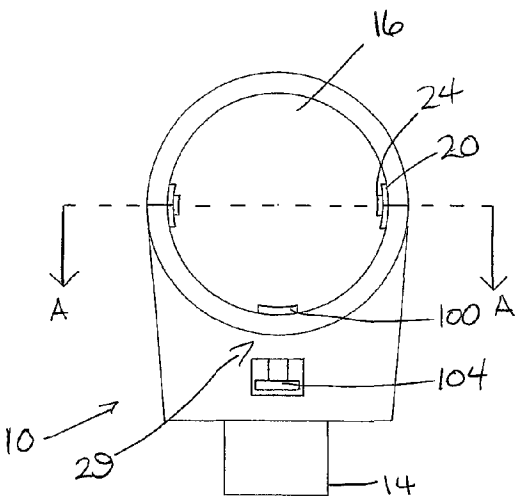
FIG. 3 is a front view of the receiving end of a first embodiment of the receiver of the present invention.

Referring to FIG. 3, receiver 10 includes an opening, such as socket 16, shaped and sized to receive a first end of a magazine 12 (not shown) and to secure it within the depths of the opening. Although the attachment between socket 16 and magazine 12 is preferably secure enough to sufficiently support magazine 12, a support flange 18 may extend from the lower side of socket 16 in order to further stabilize magazine 12. Receiver 10 further includes guide means by which a user can ensure that magazine 12 is being correctly inserted into socket 16. In the receiver embodiment shown in FIGS. 3 and 4, the guide means take the form of guide tracks 20. In the preferred embodiment, a pair of opposed guide tracks 20 are provided, but it will be understood that any suitable number of guide tracks 20 may be provided, and that they may be placed in any suitable orientation within receiver 10. Further, the thickness of guide tracks 22 may change, as at taper 22, in order to facilitate the insertion of a magazine into the receiver 10. As best seen in FIG. 4, socket 16 further comprises a gate opening means, which may take the form of one or more shoulders 24 or similar protrusions on guide tracks 20, to push open the gate of a magazine.

Figure 6:
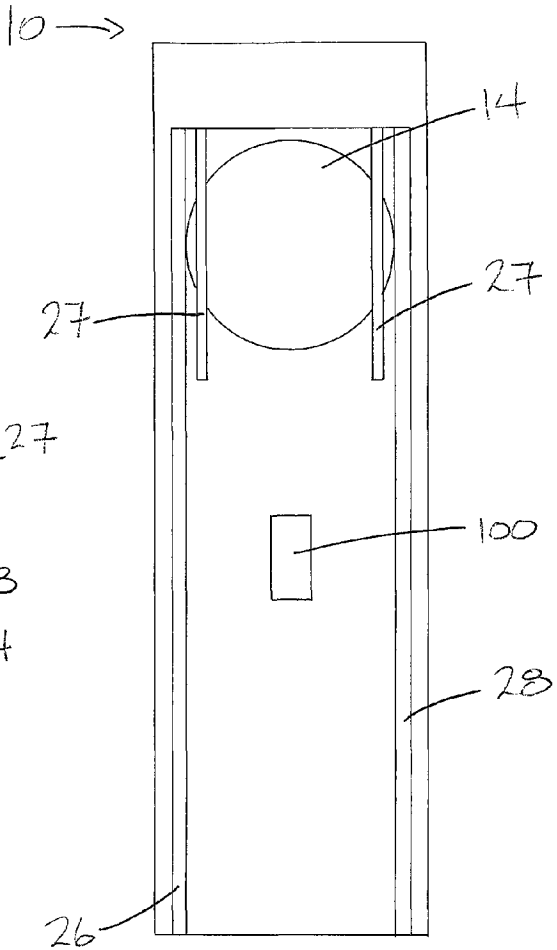
FIG. 6 is a sectional view of the receiver of FIG. 5, taken along line B-B.
Figure 5:
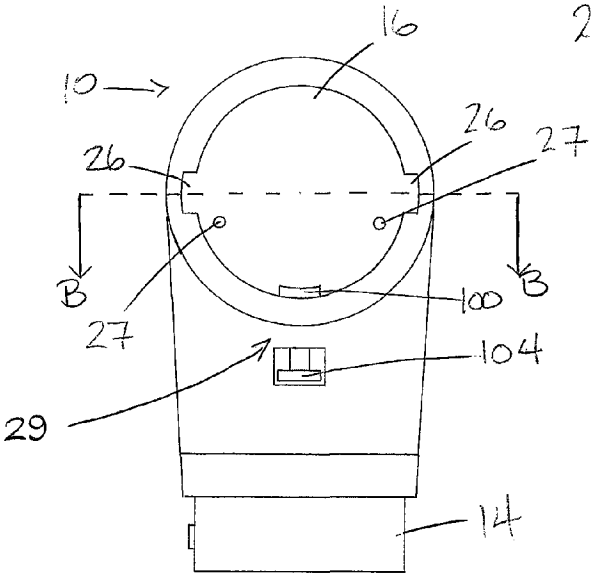
FIG. 5 is a front view of the receiving end of an alternate embodiment of a receiver.

As shown in FIGS. 5 and 6, receiver 10 may be provided with several alternative features. For example, the guide means may comprise guide slots 26, spaced and oriented as necessary to mate with the housing of magazine 12, as will be discussed later. The gate opening mechanism may take the form of one or more protruding pins 27, which will push open the gate of the magazine once the magazine is inserted into the socket 16. FIGS. 5 and 6 show a pair of protruding pins 27, but it will be understood that any number and orientation of pins may be used. It will also be understood that a single receiver may contain various combinations of the features described with reference to the two illustrated receivers, such as guide tracks 20 in combination with pins 27. Receiver 10 further preferably comprises a magazine lock mechanism 29 that interacts with magazine 12, as will be discussed later.

Figure 7:
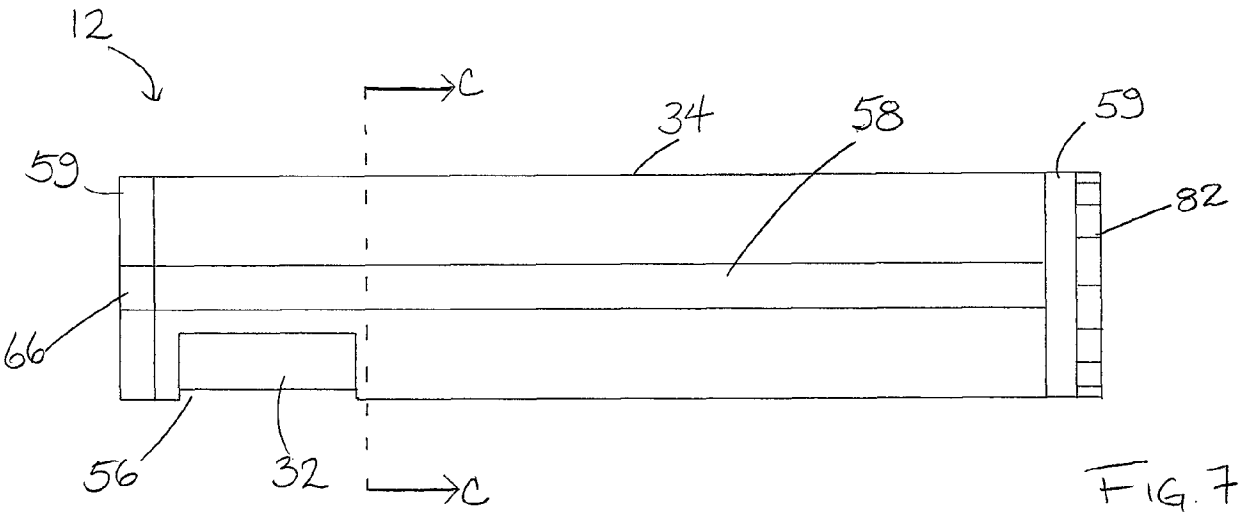
FIG. 7 is a side view of a first embodiment of the magazine of the present invention.
Figure 9:
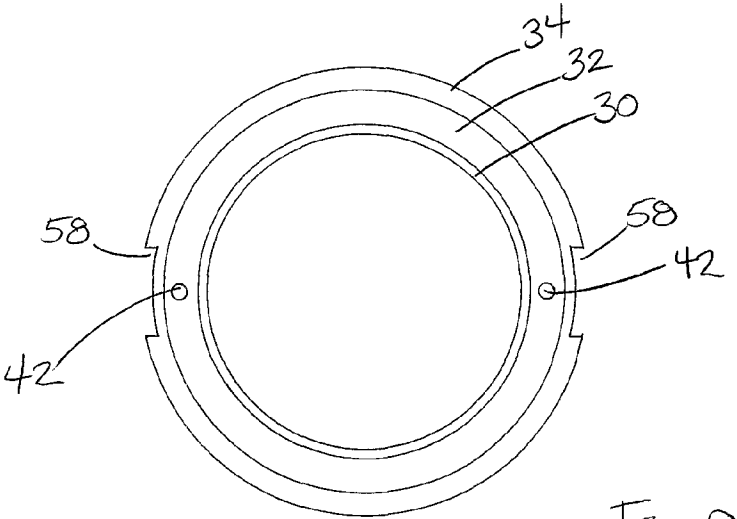
FIG. 9 is a sectional view taken along line C-C of FIG. 7.
Figure 8:
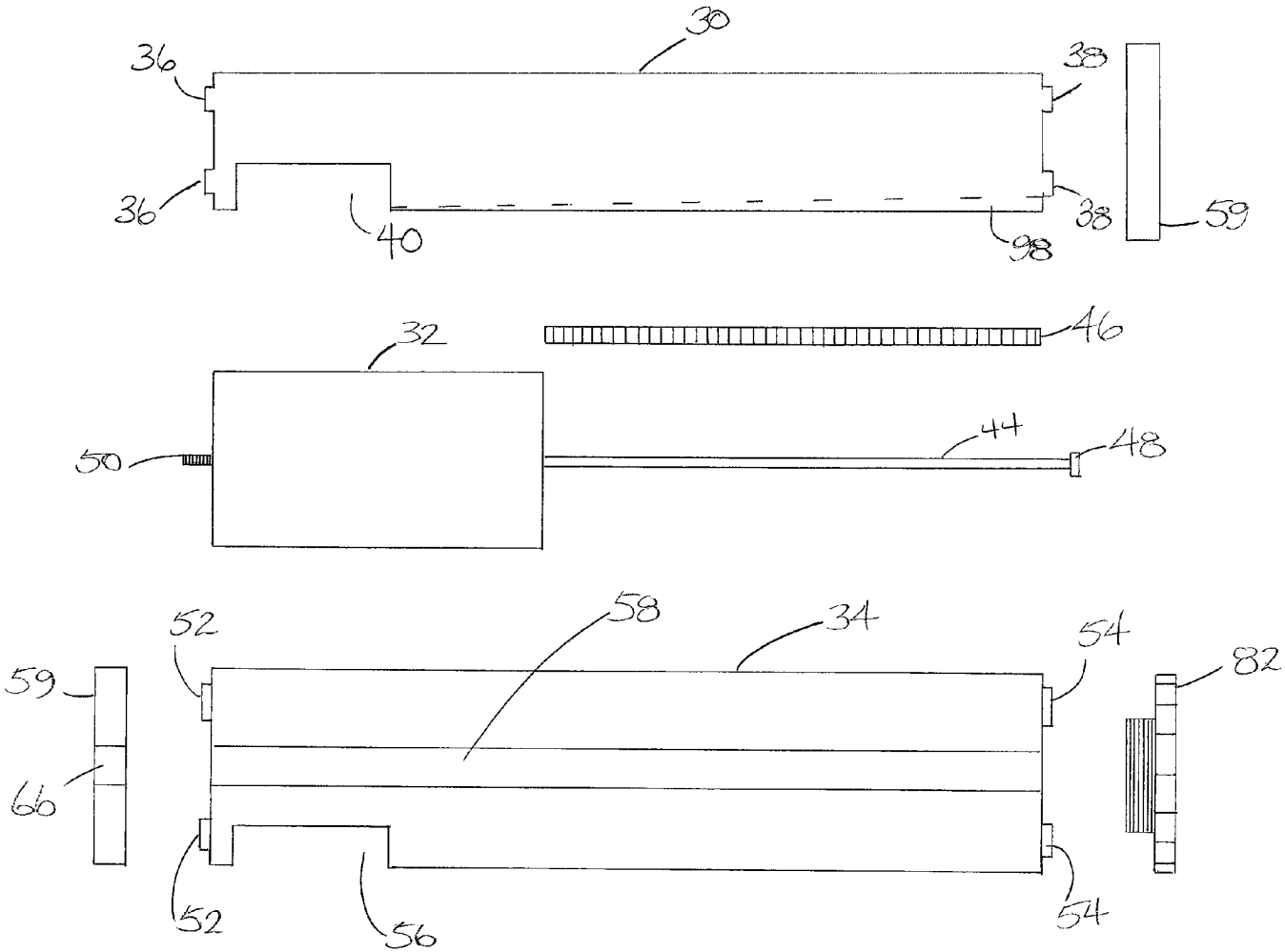
FIG. 8 is an exploded view of the assembled magazine of FIG. 7.

FIG. 7 shows a preferred embodiment of an assembled magazine 12, while FIGS. 8 and 9 show the major components of the magazine 12, including a paintball container, comprising an inner shell 30 and a gate 32, which are configured to fit within outer shell 34, as shown in FIG. 9. Inner shell 30, which in use may be filled with paintballs, comprises one or more front support tabs 36 and rear support tabs 38, along with an aperture 40. Outer shell 34 comprises one or more front support tabs 52 and rear support tabs 54, along with an aperture 56. Guide slots 58 extend at least partially along the length of outer shell 34, in an orientation and number corresponding to guide tracks 20 (not shown). Apertures 40, 56 are not necessarily identical in size, but each must be large enough to allow at least one paintball to pass through and into the receiver 10. Closure means 59, which will be discussed in more detail below, are provided to close the ends of magazine 12.

In this embodiment, gate 32 is in the form of a shell, similar to the inner shell 30 and outer shell 34, and preferably sized to nest between the inner 30 and outer 34 shells. It is preferably somewhat less elongated than inner shell 30 or outer shell 34, and includes openings 42 (FIG. 9) extending lengthwise through sidewalls of gate 32. Two openings 42 are shown, and while openings 42 are preferably opposed in order to evenly support the magazine 12, any suitable number of openings 42 may be provided in any appropriate configuration. Guide rods 44 bearing springs 46 feed through openings 42. Springs 46 are retained between the edge of gate 32 and a closure means 59. A retaining mechanism, such as the flattened heads 48 shown in FIG. 8, is located at an end of the guide rods 44 and will be used to hold the closure means on to guide rods 44. Guide rods 44 are preferably further provided with a threaded end 50, or any other suitable means by which gate 32 may be removably secured to guide rods 44. Gate 32 is thus resiliently biased into a position in which it will cover aperture 40.

Figure 10:
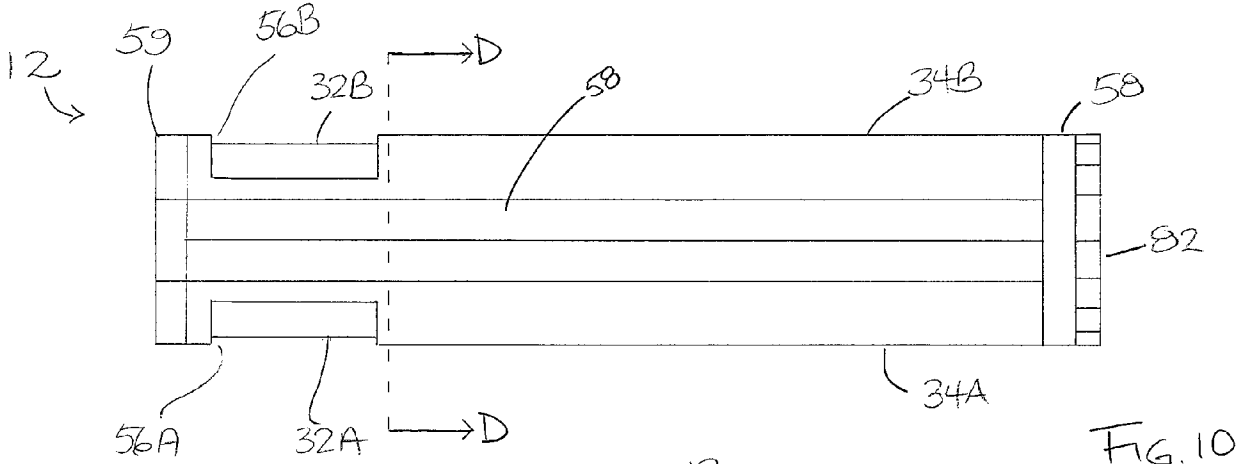
FIG. 10 is a side view of a second embodiment of the magazine of the present invention.
Figure 12:
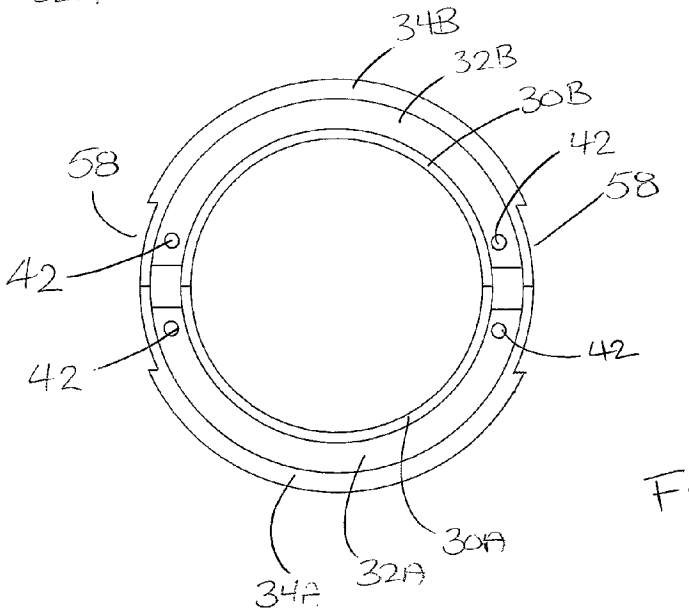
FIG. 12 is a sectional view taken along line D-D of FIG. 10.
Figure 11:
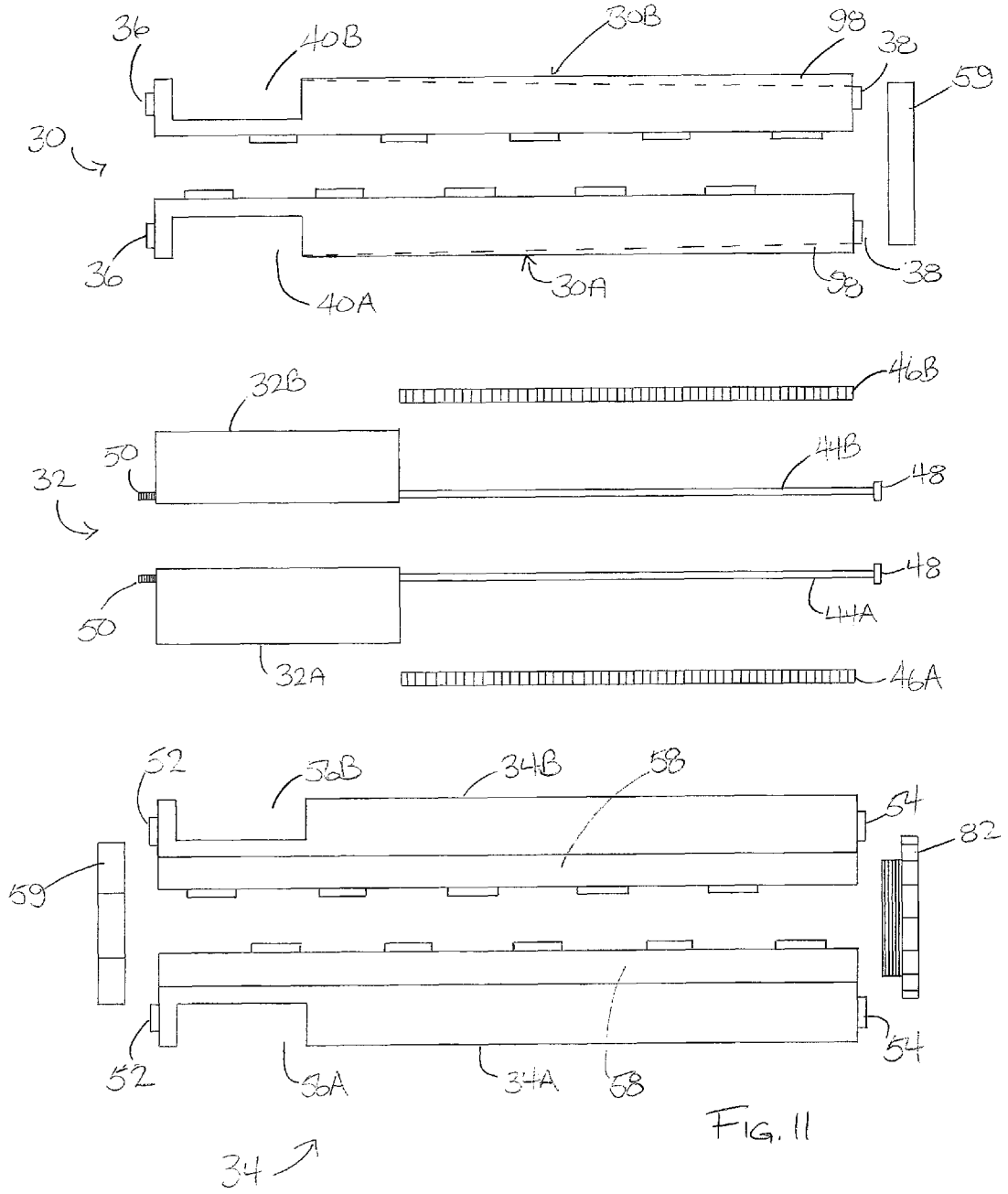
FIG. 11 is an exploded view of the assembled magazine of FIG. 10.

In an alternative embodiment, shown in FIGS. 10, 11 and 12, any or all of the shells may be divided, such that the magazine is jointed along its longitudinal axis, facilitating access to the internal parts of magazine 12, which may be particularly useful for cleaning or maintenance purposes. Inner shell 30 may comprise two interlocking partial shells 30A and 30B, while outer shell 34 comprises two interlocking partial shells 34A and 34B. Preferably the partial shells each form half of the full shell, but it will be understood that the shells may be split in any suitable manner. Guide slots 58 may be formed in outer shell 34, in a suitable number and orientation to coordinate with guide tracks 20 in receiver 10 (shown only in FIGS. 3 and 4).

Gate 32 comprises two partial gates 32A and 32B, each preferably mounted on its own set of guide rods 44A and 44B and carrying its own set of springs 46A and 46B. In the embodiment shown, an aperture 40A, 40B and 56A, 56B is provided in each of the inner and outer half shells. Independent movement of half gates 32A and 32B would therefore allow only the half gate facing down (i.e. toward the feed neck and marker) to open. The benefit of such an embodiment, besides ease of access to the inner parts of the magazine, is that the magazine may be inserted into the receiver with either set of apertures facing up. This may make insertion even faster for a user, who no longer has to examine the magazine to determine which portion should face down towards the marker.

It will be understood that it is possible to use only a single half gate 32A, particularly if only a single set of apertures 40A, 56A is provided in inner shell 30 and outer shell 34. Further, it will be understood that a half gate, or any gate 32 that does not completely encircle inner shell 30, may be used in any of the embodiments described.

Figure 13:
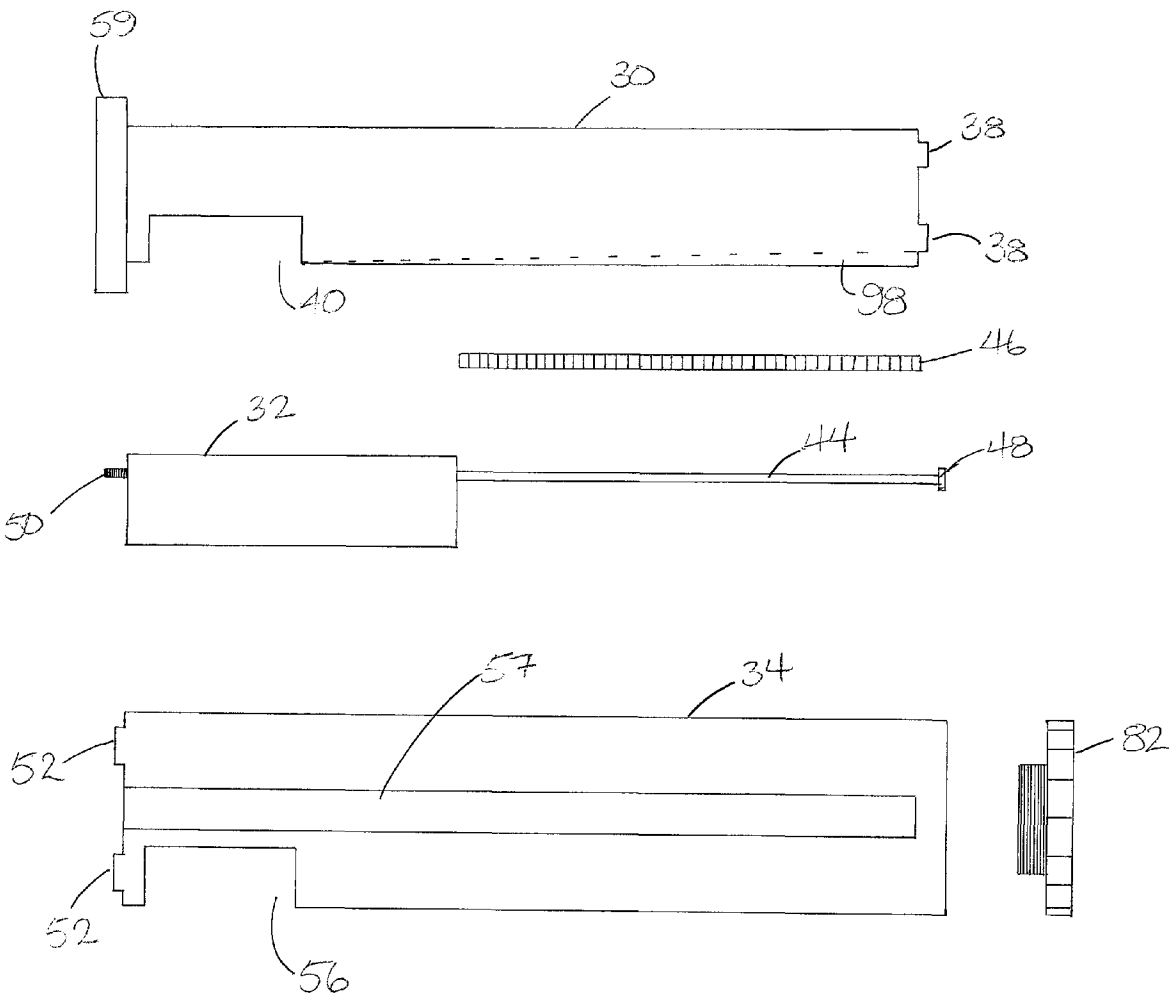
FIG. 13 is an exploded view of a third embodiment of the magazine of the present invention.

In the embodiment of the magazine 12 shown in FIG. 13, closure means 59 are provided as integral parts of inner shell 30 and outer shell 34. This eliminates the need for several separate pieces to close the ends of the magazine 12, which may simplify the system for a user. Only a sealing cap 82 or plug (not shown) would be provided to close the hole through which paintballs are loaded. FIG. 13 also illustrates the use of guide means comprising guide tracks 57 on outer shell 34, in a suitable number and orientation to coordinate with guide slots 26 in receiver 10 (shown only in FIGS. 5 and 6).

FIGS. 11 and 13 also illustrate that gate 32 may be of any suitable size, as long as it substantially covers aperture 40. Further, the length of springs 46 may be changed as necessary to accommodate a different length of gate 32, such that gate 32 substantially covers aperture 40 unless the springs 46 are substantially compressed, i.e. when the magazine 12 is inserted into a receiver.

Figures 14, 14A:
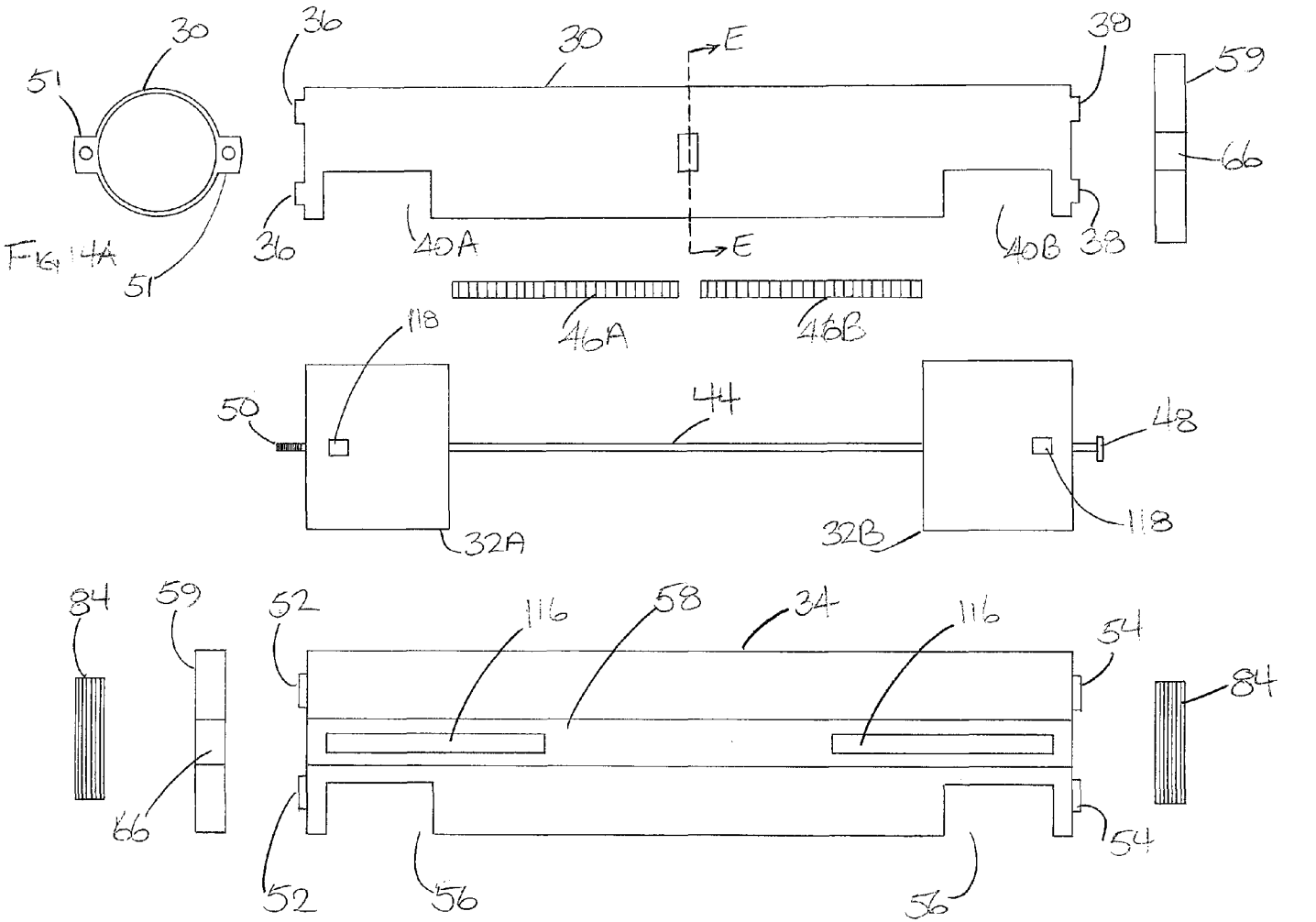
FIG. 14 is an exploded view of a fourth embodiment of the magazine of the present invention.
FIG. 14A is a sectional view taken along line E-E of FIG. 14.

In the embodiment shown in FIG. 14, springs 46 may be replaced with multiple springs 46A, 46B, which may assist in separately actuating and controlling a dual or quadruple gate mechanism. As best seen in FIG. 14A, the springs 46A, 46B at each end of magazine 12 are preferably separated by a tab 51 associated with inner shell 30, such that each set of springs may move independently of the other, allowing separate actuation of each of gate 32A, 32B to expose apertures 40A, 40B, respectively. Projection 118 on gate 32 will fit through slot 116, which may comprise all or part of guide slot 58. Insertion of a magazine including guide slots 58 and projections 118 will open gate 32 once projections 118 come in contact with shoulder 24 (shown only in FIGS. 3 and 4).

As best shown in FIGS. 11 and 14, it will be understood that it is possible to further expand the number of gate mechanisms on the magazine 12 in order to provide a magazine 12 that may be inserted in any of up to four different orientations, simply by increasing the number of apertures 40, 56 and providing one or more corresponding gates 32 for each end of the magazine.

Figure 15:
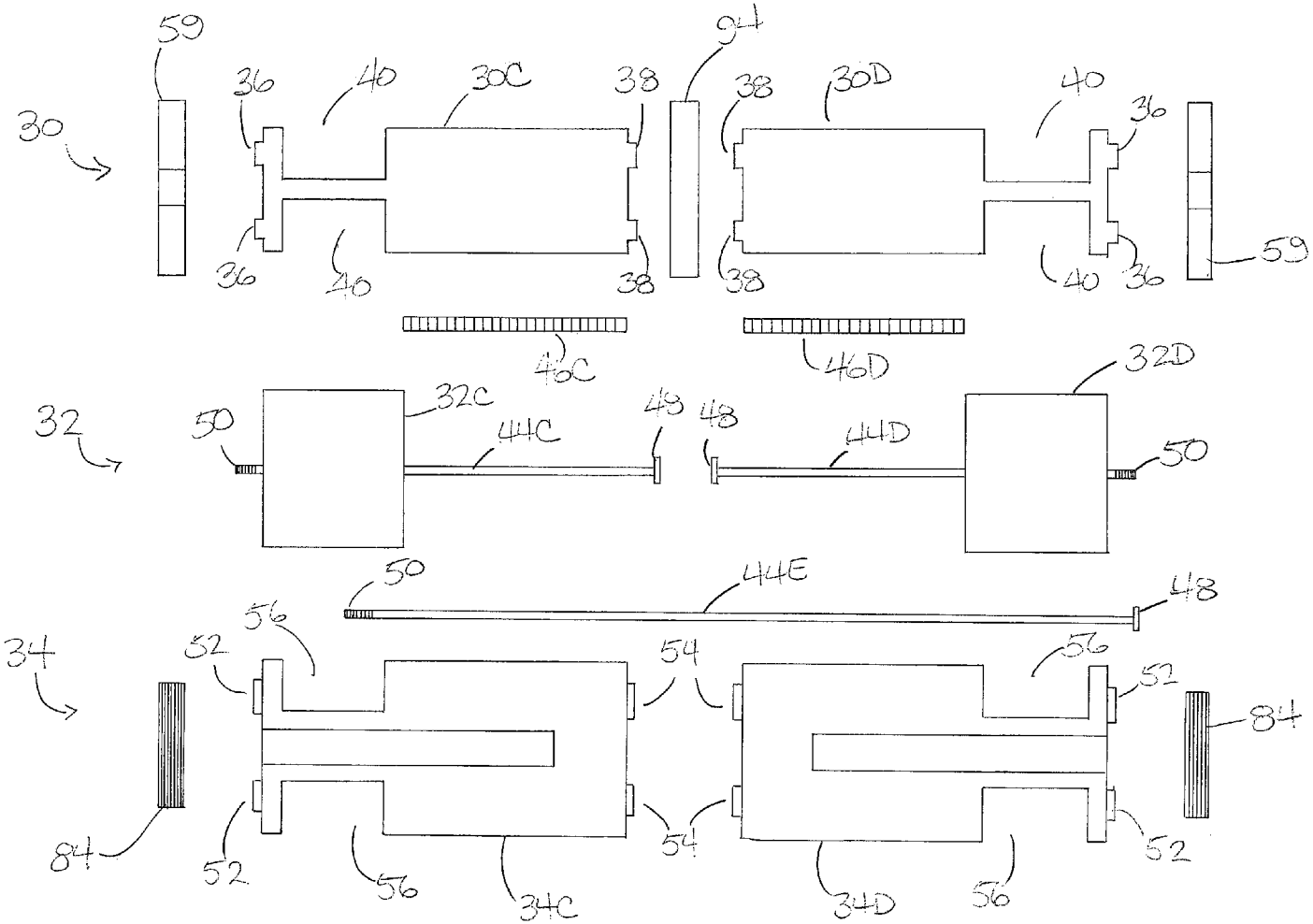
FIG. 15 is an exploded view of a fifth embodiment of the magazine of the present invention.

Another embodiment of magazine 12, intended to increase the flexibility of the magazine 12 by providing more than one magazine size, is shown in FIG. 15. In this embodiment, inner shell 30 comprises a pair of inner shells 30C, 30D. Each may have one or more apertures 40 and each has front and rear tabs 36, 38. Outer shell 34 is similarly divided into a pair of outer shells 34C, 34D, each having front tabs 52 and rear tabs 54 and one or more apertures 56. Two gates 32C, 32D, each supporting a pair of guide rods 44C, 44D and springs 46C, 46D are also provided, along with one or more closure means 59. A user may choose to use a single small magazine, for example by filling inner shell 30C with paintballs, adding gate 32C and outer shell 34C, then capping the magazine with closure means 59. Alternatively, the two small magazines may be combined into a larger magazine by joining inner shells 30C, 30D with coupling ring 94, adding gates 32C, 32D and outer shells 34C, 34D and capping the magazine with closure means 59. It will be noted that in the larger magazine configuration, guide rods 44C, 44D are preferably replaced with long guide rods 44E and springs 46C, 46D may be replaced by a longer spring (not shown). In this embodiment, it is therefore possible for a user to carry two smaller magazines or one larger magazine, depending on the parameters of his competition and/or the storage capacity of his vest or ammunition carrier.

In each embodiment, it will be evident that the paintball container of magazine 12 may comprise an outer shell 34 alone to confine the paintballs, without an inner shell 30. Gate 32, which in this embodiment would then directly contact the contained paintballs, may be tapered to prevent its movement from pinching or breaking the paintballs. Further, whether or not inner shell 30 is provided, gate 32 may be located outside outer shell 34, such that its movement will not directly contact paintballs contained within the magazine.

Figure 17:
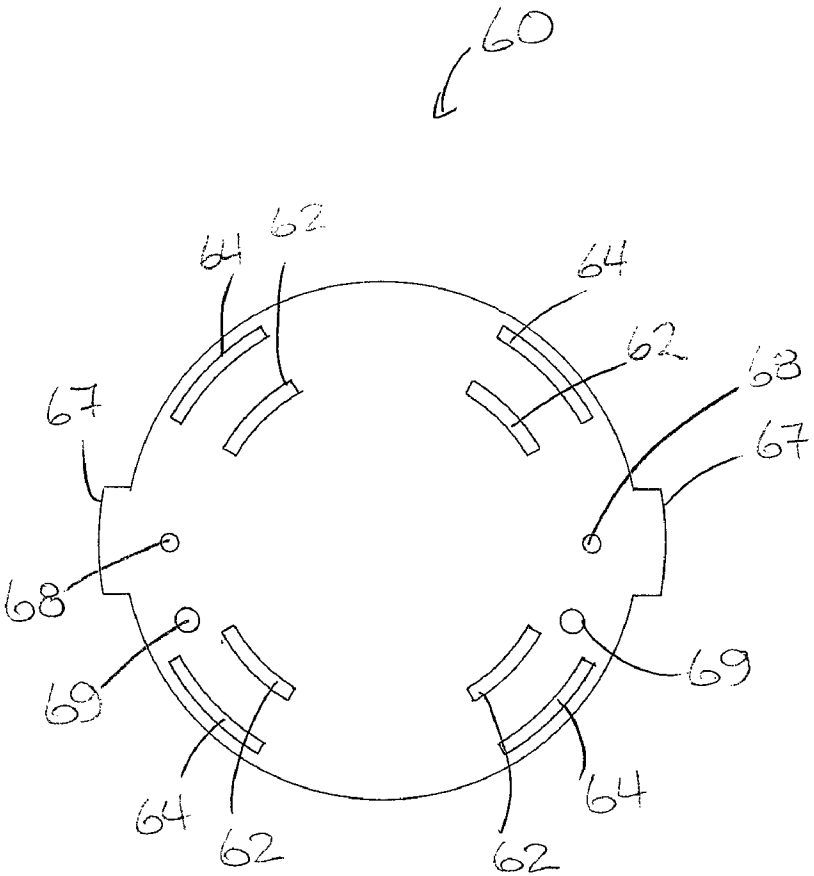
FIG. 17 is a top view of an alternative embodiment of an end cap closure means for the magazine of the present invention.
Figure 16:
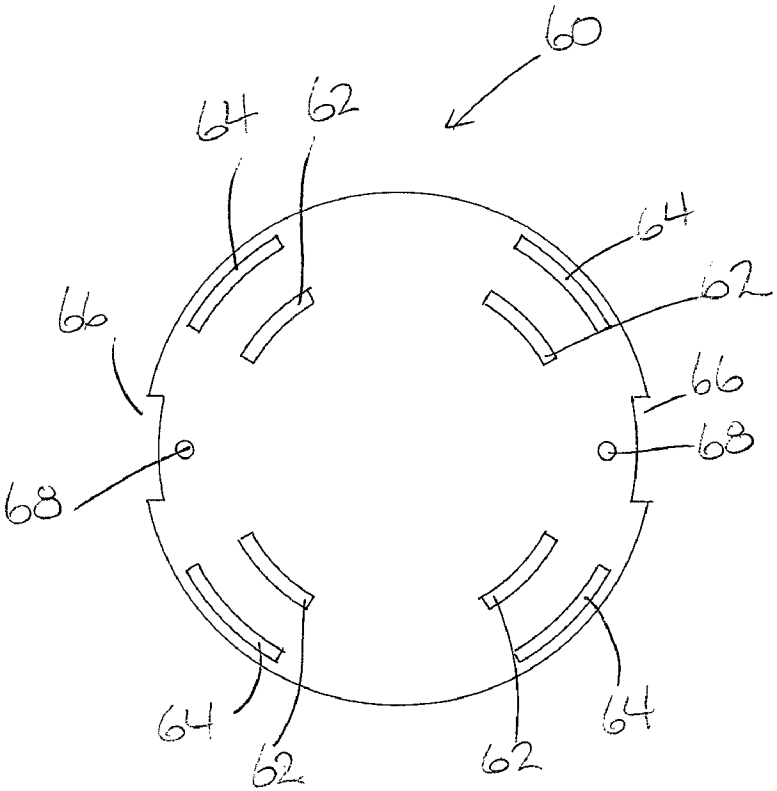
FIG. 16 is a top view of an embodiment of an end cap closure means for a magazine of the present invention.

Each of the embodiments described preferably comprises one or more closure means to close off the ends of the magazine. One embodiment of closure means is an end cap 60, shown in detail in FIG. 16, which has slots 62 to correspond to the front tabs 36 of inner shell 30, and slots 64 to correspond to the front tabs 52 of outer shell 34. End cap 60 may be a complete disk, or may further comprise notches 66 corresponding to guide tracks 20 (not shown) and locking mechanism 29, or, as shown in FIG. 17, may further comprise tabs 67 corresponding to guide slots 26. End cap 60 further comprises openings 68 to accommodate guide rods 44. If the end cap 60 is to be used with a gate opening mechanism including pins 27 (not shown), it may further include openings 69 through which pins 27 may access the gate.

Figures 18, 19, 20, 21, 22, 23:
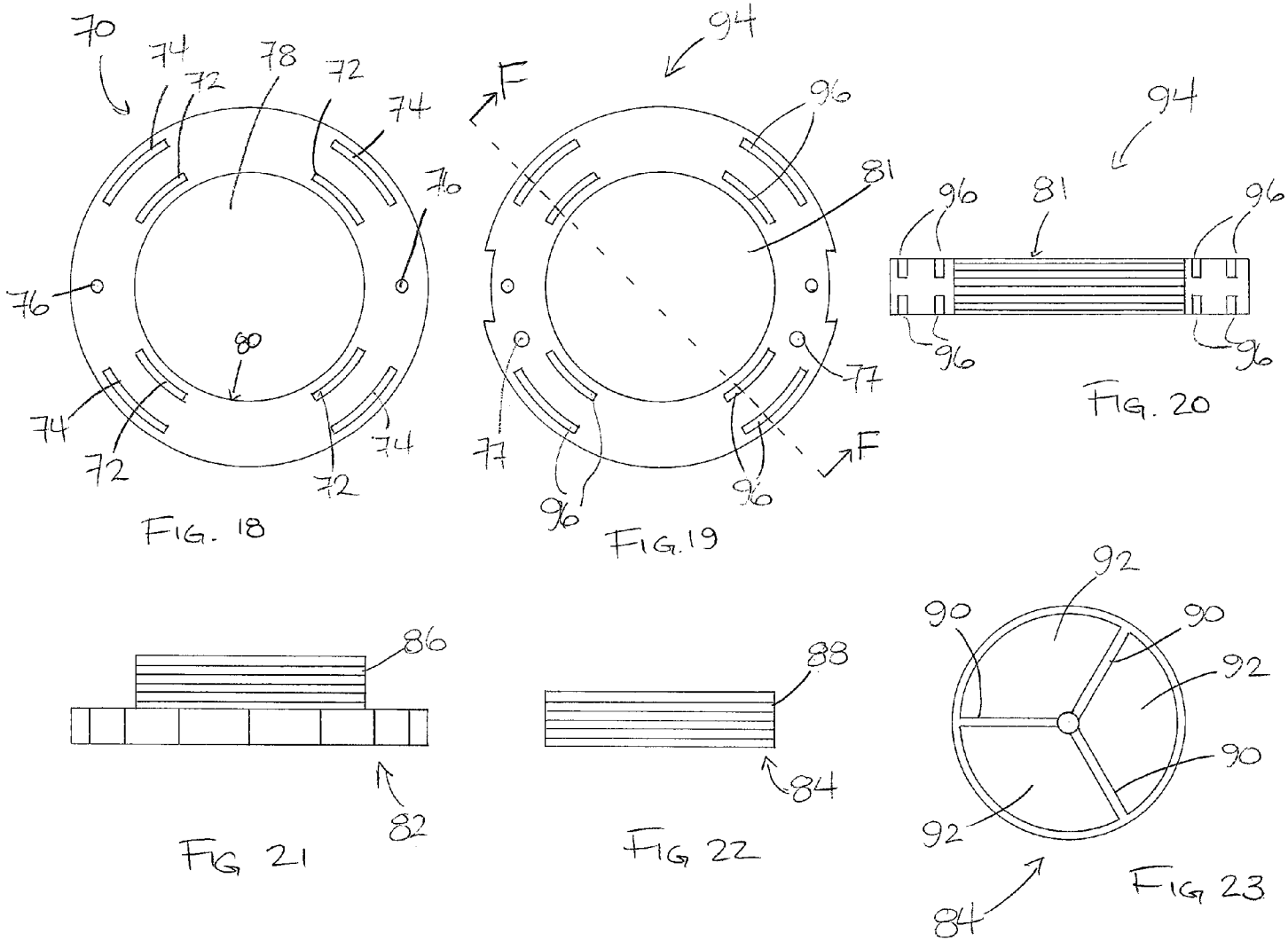
FIG. 18 is a top view of a refill cap closure means for the magazine of the present invention.
FIG. 19 is top view of a coupling means for the magazine of the present invention.
FIG. 20 is a sectional view of the coupling means of FIG. 19, taken along line F-F.
FIG. 21 is a side view of a sealing cap for the magazine of the present invention.
FIG. 22 is a side view of a sealing plug for the magazine of the present invention.
FIG. 23 is a bottom view of an embodiment of the sealing plug of FIG. 22.

Another embodiment of closure means is shown in detail in FIG. 18 as refill cap 70, which similarly comprises slots 72, 74 corresponding to rear tabs 38 and 54 of the inner and outer shells, and openings 76 to accommodate guide rods 44. Refill cap 70 further comprises a central opening 78, through which paintballs may be loaded into inner shell 30 (not shown) without disassembling the magazine. The walls 80 of central opening 78 may be threaded to accommodate removable means to close off the central opening 78, securely retaining the loaded paintballs. As with end cap 60, refill cap 70 may comprise notches or tabs to correspond to guide slots or guide tracks, or may be a complete disc, as shown.

A third closure means that may be provided is shown in FIGS. 19 and 20. Coupling ring 94 may comprise tab slots 96, spaced and oriented to receive tabs 38, 54 (not shown) of the inner and outer shells. A coupling ring may be used in the magazine embodiment shown in FIG. 15 to connect a pair of small magazines together into one larger magazine. For this situation, it is preferable that coupling ring 94 be double-sided, as shown in FIG. 20, in order to accommodate and connect both sets of shells. Openings 77 may be provided if coupling ring 94 is to be used at the front end of a magazine with a gate opening mechanism that uses pins 27 (not shown) to open the gate. In order for maximum flexibility in the use of coupling ring 94 as a closure means in a magazine, coupling ring 94 may further comprise a central opening 81, which may also be threaded to accommodate removable means to close off the central opening 81.

It will be appreciated that the various closure means 59 that have been described may be used as appropriate with any of the embodiments or combinations thereof that have been described. For example, end cap 60, refill cap 70 and coupling ring 94 may each be used at either end of a magazine 12, as long as appropriate means to close central opening 78 in refill cap 70 and central opening 81 in coupling ring 94 are provided.

One means to close central opening 78 is sealing cap 82, as shown seen in FIG. 21. Sealing cap 82 may also protect the exposed ends of the guide rods and provide further stability and security to the magazine. Sealing cap 82 may be secured to refill cap 70 by any suitable method, such as friction fit or with a threaded portion 86 inserted into central opening 78. In an alternative embodiment, sealing plug 84 may be used instead of sealing cap 82, in order to keep the magazine profile 12 slightly smaller. Sealing plug 84, shown in detail in FIG. 22, may be secured to refill cap 70 or to coupling ring 94 by any suitable method, such as a simple friction fit, or by a threaded portion 88 inserted into central opening 78 or central opening 81. In order to assist with insertion and removal of sealing plug 84, any suitable mechanism, such as a simple slot in which a coin or screwdriver may be inserted to twist free the plug, may be provided. In an alternative embodiment, one or more ribs 90, best shown in FIG. 23, may be supplied in the outer side of sealing plug 84. Ribs 90 are preferably spaced to form one or more notches 92, into which a user may insert fingers, pliers or any other tool that would assist in unseating sealing plug 84.

Referring to the preferred embodiment illustrated in FIGS. 5 and 7-9, as the magazine 12 is inserted into receiver 10, guide slots 26 mesh with guide tracks 57, leading magazine 12 properly into socket 16. The gate opening means of receiver 10 interacts with gate 32, moving the gate 32 toward refill cap 70 against the force of springs 42. This movement of the gate 32 uncovers apertures 40, 56, exposing paintballs in magazine 12 and allowing them to flow into the receiver 10 and through feed neck 14 into the marker. The insertion action is, for the user, essentially a one-step, intuitive motion, allowing simple, rapid loading of the magazine into the receiver.

Figure 27:
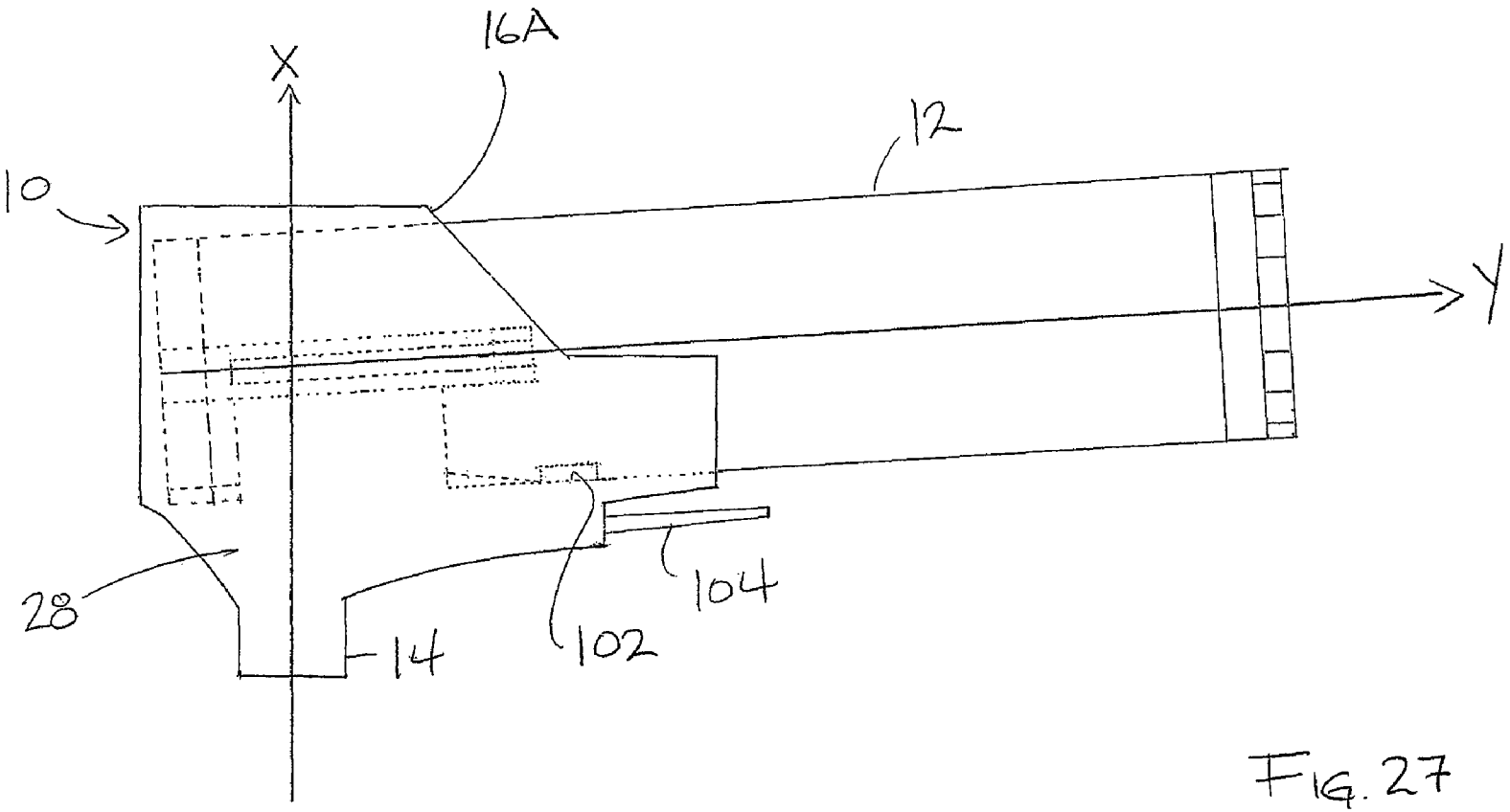
FIG. 27 is a side view of an alternative embodiment of the loading and feeding assembly of the present invention.

The paintball flow toward feed neck 14 may be assisted simply by the user tilting the marker forward occasionally, or the magazine 12 may be provided with an internal ramp 98, best shown in FIG. 8. Ramp 98 may be of any suitable slope, although as small a slope as possible is preferred, in order to maximize the number of paintballs that may be accommodated by inner shell 30. A further alternative, shown in FIG. 27, provides socket 16A being tilted up and away from the marker, such that when magazine 12 is inserted into socket 16A, the central longitudinal axis X of the socket 16A is not perpendicular to the central longitudinal axis Y of the feed neck 14. Magazine 12 is therefore angled up with respect to the marker body, gravity feeding the paintballs towards feed neck 14. Any suitable angle may be chosen, although it may be preferable to choose a relatively small angle in order to maintain an overall low marker profile. Further, in some embodiments a ramp 98 and a tilted socket 16A may be employed together. As mentioned earlier, a mechanical, pneumatic or electric feeding assist means 19 (shown in FIG. 2A) may be used within the receiver 10 to further assist paintball flow through the marker.

Figure 2A:
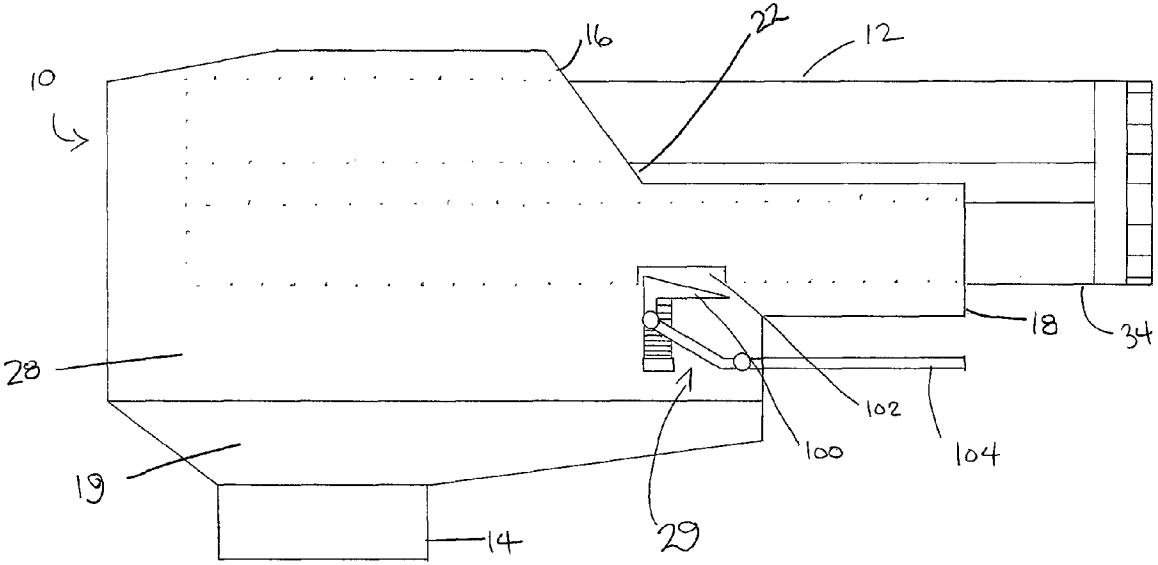

The receiver may also include a magazine lock mechanism 29, best shown in FIG. 2A. Lock member 100 is generally biased in an extended position, protruding into socket 16, but is forced out of that extended position by the movement of magazine 12 as it is inserted into receiver 10. Once magazine 12 is correctly positioned in receiver 10, lock member 100 engages with lock slot 102 in outer shell 34, releasing the pressure on lock member 100 and allowing it to protrude into lock slot 102, thus locking the magazine 12 in position. When the magazine 12 is empty, an ejection mechanism, such as trigger 104, is activated, retracting lock member 100 from engagement with slot 102. Because gate 32 is in a retracted position, in which springs 46 (not shown) are compressed, the release of lock member 100 allows springs 46 to extend, ejecting the magazine 12 from receiver 10. The spring force of springs 46 may be chosen to provide a suitable amount of force for the ejection mechanism. For example, in tournament play, it may be most important to rapidly eject the magazine and to ensure that it travels some distance away, so it does not hinder the player. In that situation, more spring force would therefore be preferable. In other situations, the user might prefer that he be able to return a used magazine to his vest. This would require a lighter spring so the user can simply pull the released magazine from the receiver, or can easily retrieve it from nearby.

Figure 24:
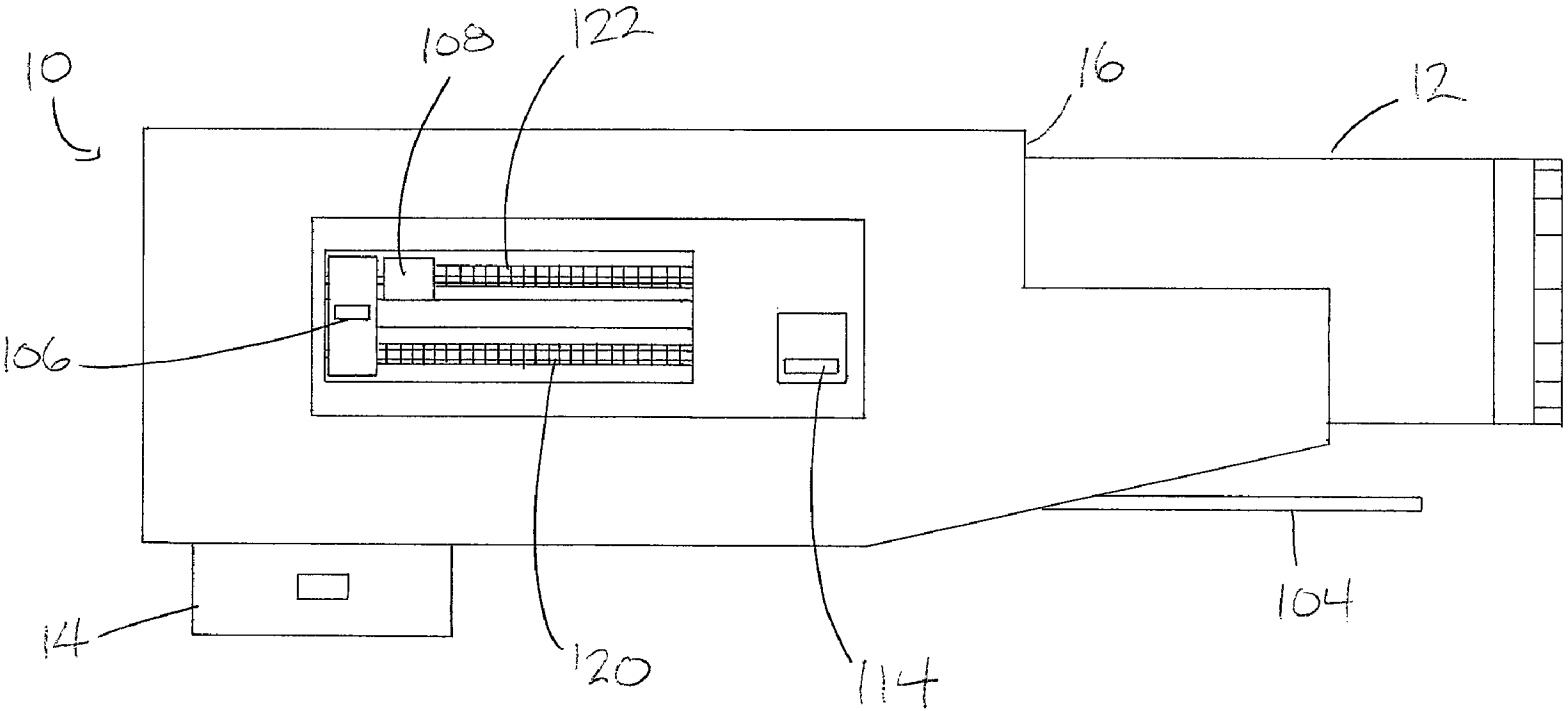
FIG. 24 is a side view of another alternative embodiment of the receiver of the present invention.
Figure 26:
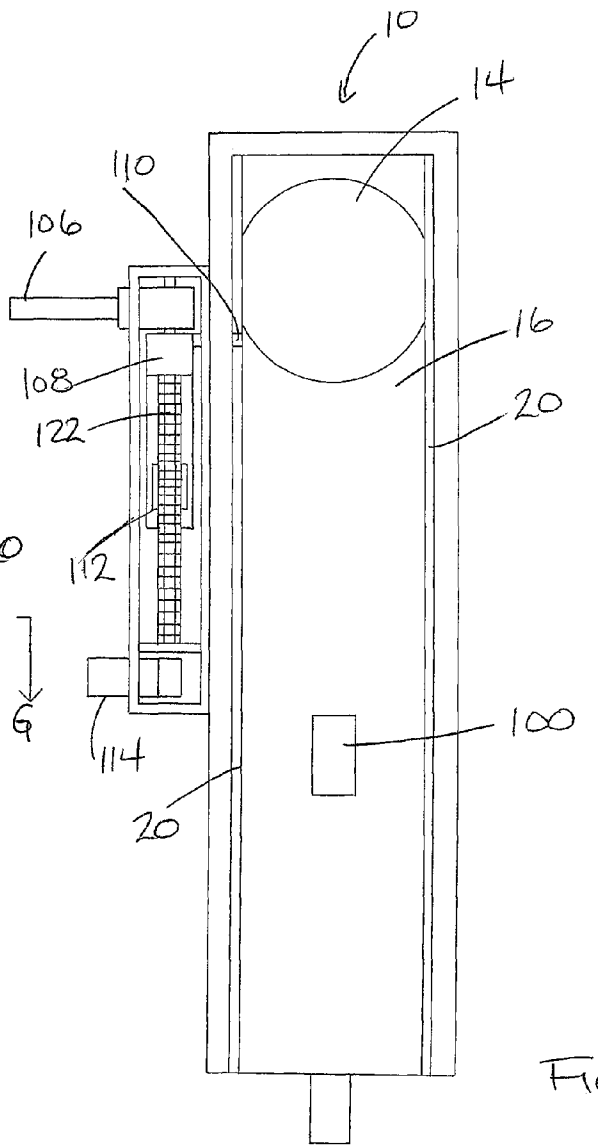
FIG. 26 is a sectional view of the receiver embodiment of FIGS. 24 and 25, taken along line G-G of FIG. 25.
Figure 25:
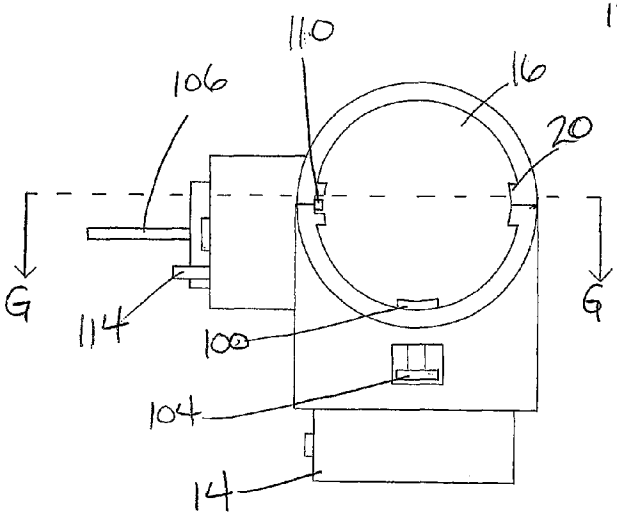
FIG. 25 is a front view of the receiving end of the receiver embodiment of FIG. 24.

Some users may prefer a more realistic feel to the loading and feeding system of the invention over the pure insertion speed of the loading systems already disclosed. This may be achieved by providing a cocking mechanism, allowing a user to insert a magazine into the receiver and cock the marker to open the gate in the magazine, accessing the supply of paintballs. This embodiment, best shown in FIGS. 24, 25 and 26, includes a receiver 10, which may otherwise resemble any of the receiver embodiments already described, modified by the addition of a protruding cocking handle 106. Further, in the embodiment shown, guide tracks 20 are not provided with a shoulder or any particular gate opening means to open the gate in the magazine 12 (not shown). When magazine is inserted into socket 16, it preferably locks into place with magazine lock mechanism 29, but the gate remains closed. When a user moves cocking handle 106, this causes associated catch member 108 to move in a coordinated manner. Tip 110 of catch member 108 protrudes into socket 16 and engages with the gate in the magazine, such as through guide slots 58 (not shown), opening the gate. When the catch member 108 has moved the gate enough to expose the apertures in the magazine, it is preferably caught and restrained by a latch 112, thus holding the gate open. Cocking handle 106 is preferably biased, such as by spring 120, to return to the position shown in FIG. 25 upon release. Once the magazine has been emptied, or whenever the user decides to remove or replace it, latch release handle 114 can be activated, releasing catch member 108, which is preferably also biased, such as by spring 122, to the position shown in FIG. 25. This releases the gate in the magazine and allows it to close, readying the magazine for removal as soon as the user unlocks the emptied magazine by activating trigger 104. A user may also pre-cock the handle, such that catch member 108 is caught and held by latch 112 before inserting the magazine. In this case, tip 110 of catch member 108 will open the gate of the magazine as it is inserted, acting as a gate opening mechanism in a similar manner to the shoulder 24 described in other embodiments.

It will be appreciated by those skilled in the art that other variations to the preferred embodiment described herein may be practiced without departing from the scope of the invention, such scope being properly defined by the following claims.

The invention claimed is:

1. A magazine for storing and feeding paintballs to a paintball marker, said magazine comprising:

a paintball container adapted to hold paintballs, said container comprising at least one aperture located near a first end of said container, and further comprising:

an inner shell adapted to hold paintballs, said aperture being located near a first end of said inner shell; and an outer shell, sized to encircle said inner shell and comprising at least one aperture corresponding to the aperture in said inner shell;

a gate, resiliently biased to cover said apertures; and closure means to at least partially cover said first end and a second end of said container.

2. The magazine of claim 1 further comprising at least one guide rod carrying at least one spring to bias said gate to cover said aperture in said paintball container, wherein said gate comprises at least one opening to accommodate said at least one guide rod.

3. The magazine of claim 1 wherein said paintball container further comprises at least one ramp within said inner shell, said ramp sloping towards said aperture.

4. The magazine of claim 1, further comprising a sealing cap to cover said closure means at the first or second end of said container.

5. The magazine of claim 1, further comprising a sealing plug to fill an opening in said closure means at the first or second end of said container.

6. The magazine of claim 1 wherein an outer surface of said container comprises at least one guide slot adapted to interact with a receiver to guide said magazine into said receiver.

7. The magazine of claim 6 wherein said gate further comprises a projection through said at least one guide slot, said projection being adapted to interact with said receiver to push said gate away from said aperture.

8. The magazine of claim 1 wherein an outer surface of said container comprises at least one guide track adapted to interact with a receiver to guide said magazine into said receiver.

9. The magazine of claim 1 wherein an outer surface of said container further comprises a slot adapted to interact with a lock mechanism in a receiver to secure said magazine in said receiver.

10. The magazine of claim 1 wherein said at least one aperture comprises at least two apertures at said first end.

11. The magazine of claim 1 wherein said at least one aperture comprises at least two apertures, one at each of said first and second ends.

12. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening, said guide means comprising:

at least one guide track adapted to cooperate with a guide slot on said magazine, said at least one guide track being tapered at an end distant from said feed neck; and gate opening means to open a side portion of said magazine, allowing paintballs to move towards said feed neck from said side portion.

13. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening;

gate opening means to open a side portion of said magazine, allowing paintballs to move towards said feed neck from said side portion; and a support flange extending from a lower portion of said opening.

14. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening; and gate opening means to open a side portion of said magazine, allowing paintballs to move towards said feed neck from said side portion, said gate opening means comprising cocking means to manually pull said magazine open.

15. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening; and gate opening means to open a side portion of said magazine, allowing paintballs to move towards said feed neck from said side portion, said gate opening means comprising at least one protrusion on said guide means to open said magazine.

16. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening; and gate opening means to open a side portion of said magazine, allowing paintballs to move towards said feed neck from said side portion, said gate opening means comprising at least one pin within said opening to open said magazine.

17. A receiver to load a paintball marker with paintballs from a magazine, said receiver comprising:

an opening in communication with a feed neck, said opening being adapted to receive and enclose a first end of said magazine;

at least one guide means within said opening to guide insertion of said magazine into said opening;

gate opening means to open a side portion of said magazine, allowing paintballs to move towards said feed neck from said side portion; and a paintball feed assist means to move said paintballs from said magazine toward said feed neck.

18. A loading and feeding assembly for a paintball marker comprising:

a magazine adapted to hold paintballs, said magazine comprising a gate biased to cover at least one aperture in a side portion of said magazine, and at least one magazine guide means; and a receiver mountable on said marker, said receiver comprising:

an opening adapted to enclose a front end of said magazine; guide means on said magazine; and gate opening means within said opening to open said magazine by moving said gate away from said aperture, said gate opening means comprising at least one shoulder on said receiver guide means, said shoulder being adapted to interact with at least one protrusion on said magazine guide means to move said gate away from said aperture.

19. A loading and feeding assembly for a paintball marker comprising:

a magazine adapted to hold paintballs, said magazine comprising a gate biased to cover at least one aperture in a side portion of said magazine, and at least one magazine guide means; and a receiver mountable on said marker, said receiver comprising:

an opening adapted to enclose a front end of said magazine;

receiver guide means within said opening corresponding to said guide means on said magazine; and gate opening means within said opening to open said magazine by moving said gate away from said aperture, said gate opening means comprising at least one pin within said opening, said pin being adapted to push said gate away from said aperture.

20. A loading and feeding assembly for a paintball marker comprising:

a magazine adapted to hold paintballs, said magazine comprising a gate biased to cover at least one aperture in a side portion of said magazine, and at least one magazine guide means; and a receiver mountable on said marker, said receiver comprising:

an opening adapted to enclose a front end of said magazine;

receiver guide means within said opening corresponding to said guide means on said magazine; and gate opening means within said opening to open said magazine by moving said gate away from said aperture, said gate opening means comprising a cocking handle to manually pull said gate away from said aperture.

21. A loading and feeding assembly for a paintball marker comprising:

a magazine adapted to hold paintballs, said magazine comprising:

a gate biased to cover at least one aperture in a side portion of said magazine, and at least one magazine guide means; and at least one internal ramp, said ramp sloping towards said aperture; and a receiver mountable on said marker, said receiver comprising:

an opening adapted to enclose a front end of said magazine;

receiver guide means within said opening corresponding to said guide means on said magazine; and gate opening means within said opening to open said magazine by moving said gate away from said aperture.

22. A loading and feeding assembly for a paintball marker comprising:

a magazine adapted to hold paintballs, said magazine comprising a gate biased to cover at least one aperture in a side portion of said magazine, and at least one magazine guide means, said at least one aperture comprising two apertures towards a front end of said magazine; and a receiver mountable on said marker, said receiver comprising:

an opening adapted to enclose said front end of said magazine;

receiver guide means within said opening corresponding to said guide means on said magazine; and gate opening means within said opening to open said magazine by moving said gate away from said aperture.

23. A loading and feeding assembly for a paintball marker comprising:

a magazine adapted to hold paintballs, said magazine comprising a gate biased to cover at least one aperture in a side portion of said magazine, and at least one magazine guide means, said at least one aperture comprising two apertures, one at each of a front end and a rear end of said magazine; and a receiver mountable on said marker, said receiver comprising:

an opening adapted to enclose said front end of said magazine;

receiver guide means within said opening corresponding to said guide means on said magazine; and gate opening means within said opening to open said magazine by moving said gate away from said aperture.

24. A loading and feeding assembly for a paintball marker comprising:

a magazine adapted to hold paintballs, said magazine comprising a gate biased to cover at least one aperture in a side portion of said magazine, and at least one magazine guide means;

a receiver mountable on said marker, said receiver comprising:

an opening adapted to enclose a front end of said magazine;

receiver guide means within said opening corresponding to said guide means on said magazine; and gate opening means within said opening to open said magazine by moving said gate away from said aperture; and a paintball feed assist means to more said paintballs from said magazine toward said marker.

* * * * *